US006102809A

United States Patent [19]

Nichols

[11] Patent Number: 6,102,809

[45] Date of Patent: Aug. 15, 2000

[54] ATHLETIC STROKE TRAINING DEVICE

[75] Inventor: Steven B. Nichols, Los Angeles, Calif.

[73] Assignee: Kswiss, Inc., Chatsworth, Calif.

[21] Appl. No.: 08/948,629

[22] Filed: Oct. 10, 1997

[51] Int. Cl.[7] ..... A63B 69/36

[52] U.S. Cl. ..... 473/227; 473/461

[58] Field of Search ..... 473/227, 258, 473/276, 454, 277, 461

[56] References Cited

U.S. PATENT DOCUMENTS

| | | | |
|---|---|---|---|
| 2,986,314 | 5/1961 | Miller | 473/227 |
| 3,109,244 | 11/1963 | Trifaro | 473/227 |
| 3,820,781 | 6/1974 | Kane | 473/227 |
| 5,269,528 | 12/1993 | McCardle | 473/276 |
| 5,658,203 | 8/1997 | Shub | 473/276 |
| 5,785,603 | 7/1998 | Lazier | 473/277 |

*Primary Examiner*—Sam Rimell

[57] ABSTRACT

An athletic stroke training device is disclosed. The training device has a semi-rigid shaft that is attached to a player's shoulders or hips by incorporating the shaft into the garment worn by the player or by use of a shoulder harness. The shaft has a length slightly wider than shoulder width and includes indicators at each end to give the player a visual cue for proper shoulder or hip rotation. The shaft can be telescoping or made of a helical spring. The indicators can be a flag, disks, suspended balls, cones, or illuminated light emitting sources such as a bulb, a neon strobe, or an LED. Furthermore, the indicator can be constructed from a ring supported by radial struts to be used as a sight for aiming the stroke. The stroke training device is easily adapted for use in many sports that entail shoulder or hip rotation such as tennis, golf, hockey, baseball, etc.

3 Claims, 5 Drawing Sheets

ATHLETIC STROKE TRAINING DEVICE

BACKGROUND OF THE INVENTION

1. Field of the Invention

The present invention is directed to an athletic stroke training device. More precisely, the present invention is directed to a horizontal alignment member that attaches to a player's shoulders or hips to help him or her perform proper shoulder or hip rotation during a rotational stroke in tennis, golf, or similar sport.

2. Description of the Related Art

In many sports, proper shoulder, upper torso, or hip rotation is important to generating power in a particular shot. For example, the importance of shoulder rotation in the game of tennis to achieve a powerful forehand or backhand is well known. Likewise, proper shoulder rotation and hip action are recognized keys to a smooth and powerful golf swing.

There have been attempts at improving the stroke of a player by use of a prop or similar accoutrement. For example, a stroke training device known in the art is comprised of a guide member connected between the player's body and a stroking device such as a tennis racket or golf club. The intent is to focus the force of the player's body rotation at a constant radius as the player's body moves among the forward stroke, the back stroke, and the follow through positions. The guide member includes a reference surface located between the gripped, hand end of the stroking device and the player's body for defining a vertically extending reference plane located wholly between the hand end of the stroking device and body within the constant radius of swing and moveable into a stroking or hitting plane, including the object to be hit. Essentially, the stroking device links the hand position of the player to his/her hip on the racket or club side along with the upper torso. Use of the device insures that the player undergoes body rotation and locates the player's hand at a fixed and repeatable distance from the player's body. An example of this device is disclosed in U.S. Pat. No. 5,257,779 to Dalbo.

Other stroke training devices include U.S. Pat. No. 3,672,682 to Yanagidaira and U.S. Pat. No. 5,269,528 to Mc Cardle, Jr. The Yanagidaira reference is directed to a golf putter improvement device that aides proper relative positioning of the golfer's arms. The improvement device is an elongated strip or plate of lightweight wood, plastic, or the like, and has at opposite ends curved portions adapted to be interposed between and to engage snugly against portions of the golfer's arms. While using the device, the golfer practices putting with his arms fixed or stabilized slightly separated from his body.

The McCardle, Jr. reference discloses a golf training device having a shaft with a lighting means located in each end of the shaft with a light beam emitted from each lighting means directed away from the shaft. Apparently, the device allows the golfer to visualize through light illumination the mechanics of a proper golf swing to develop muscle memory.

Another athletic training device is disclosed in U.S. Pat. No. 5,520,392 to Foresi, which is directed to a golf training device for teaching a pendulum type putting swing. Lastly, U.S. Pat. No. 5,344,323 to Burns discloses an electronic device for teaching in real time the movement of a selected part of a person's body beyond a desired boundary limit. The device is constructed from battery powered tone generators attached to the limbs or other parts of the user's anatomy.

Depending on orientation and attitude of that limb, off axis mercury switches are activated to generate an audible signal alerting the user to an improper posture or an exceeded boundary limit.

Despite the foregoing efforts in the field, there is still a need for an athletic stroke training device that is easily adapted to fit on a player's body to help him or her improve shoulder, torso, or hip rotation. Through such improvements in body mechanics, the efficiency, consistency, and power of the stroke are enhanced.

SUMMARY OF THE INVENTION

In view of the foregoing, it is an object of the present invention to provide an athletic stroke training device that assists a player in proper shoulder rotation, upper torso rotation, and/or hip rotation. It is another object of the present invention to provide a training device that is easily attached to a player's body. It is still another object of the present invention to provide a stroke training device that is durable yet lightweight to withstand the rigors of sports activities. It is still yet another object of the present invention to provide a stroke training device that is unobtrusive so as to not interfere with the proper execution of the stroke by the player.

In order to achieve the foregoing objects, the present invention in a preferred embodiment is directed to an athletic stroke training device for mounting to a player having a body with shoulders and hips, the invention comprising a horizontal alignment member having opposed ends separated by about a shoulder width, and an indicator at each opposed end of the horizontal alignment member having a visual stimulus, wherein the stroke training device is attached to the player's body. In the exemplary embodiments, the present invention stroke training device can be attached to either the shoulder or the hip area to help the player achieve proper should or hip rotation.

In the preferred embodiment, the horizontal alignment member is a generally straight rod that is attached to a harness worn over the shoulder of the player. The visual stimulus is preferably a flag located at each end of the rod to help attract the eye of the player. Ideally, the present invention is used for improving a tennis ground stroke or a golf swing. Thus in the tennis application, for example, proper shoulder rotation for a forehand or backhand is indicated by alignment of the horizontal alignment member with the oncoming ball, or a target on the court used to aim the shot. A visual stimulus aside from a flag such as a disk, a cone-shape bumper, a dome-shaped bumper, a light emitting lamp, or the like can also be useful in providing a visual cue for the player to adjust his or her posture prior to, during, and after the stroke.

As a further aid in aiming or alignment of the shoulders or hips with the target or ball, the present invention in an alternative embodiment provides a sight comprising a ring supported at each end of the horizontal alignment member by radially extending struts. Thus, the player can use the ring to sight an oncoming ball and adjust his shoulder rotation and body posture accordingly.

In yet another alternative embodiment, the present invention athletic stroke training device can be incorporated into the garment worn by the player so that the indicator at each end of the horizontal alignment member extends from the shoulders or hips. In still another alternative embodiment, the vertical location of the horizontal alignment member can be adjusted up and down to fit the physique of the player. This can be accomplished by attaching the horizontal alignment member to an adjustable shoulder harness, or to a garment by use of complementary hook and loop fasteners, known in the art as VELCRO.

Therefore, the present invention athletic stroke training device can substantially improve a player's stroke production and power by guiding him or her through proper shoulder or hip rotation. The present invention stroke training device is further easily adaptable to the player's garment, or can be attached to the body with a lightweight harness. These and other advantages of the present invention will become apparent from the following detailed description thereof when taken in conjunction with the accompanying exemplary drawings.

DETAILED DESCRIPTION OF THE PREFERRED EMBODIMENTS

The following specification describes an athletic stroke training device for improving a player's performance in a particular sport. In the description, specific materials and configurations are set forth in order to provide a more complete understanding of the invention. It is understood by those skilled in the art that the present invention can be practiced without those specific details. In some instances, well known elements are not described precisely so as not to obscure the invention.

The present invention is directed to an athletic stroke training device for mounting to a player having a body with shoulders and hips, the training device comprising a horizontal alignment member having opposed ends separated by about a shoulder width and an indicator at each opposed end of the horizontal alignment member having a visual stimulus, wherein the stroke training device is attached to the player. In various exemplary embodiments, the athletic stroke training device can be attached to the player's shoulders, hips, or upper torso.

It is recognized that the present invention is useful as a training device for learning proper shoulder, hip, or upper torso rotation, which is key in a variety of sports activities. Those sports activities include tennis, golf, hockey, baseball, to name a few. In the following, the description of the exemplary embodiments is in the context of tennis, although it is recognized and contemplated that the present invention can be adapted to a wide variety of sports activities outside of tennis.

Figure 1A:
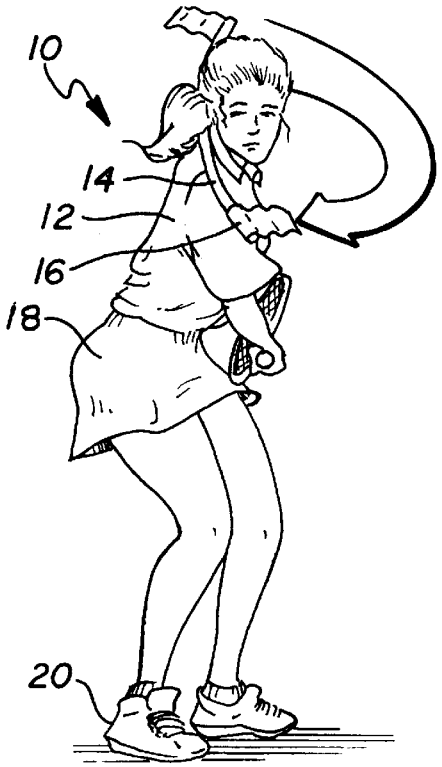
FIGS. 1A, 1B, and 1C depict a preferred embodiment of the present invention athletic stroke training device attached to the shoulders of a tennis player executing a backhand stroke.
Figure 1B:
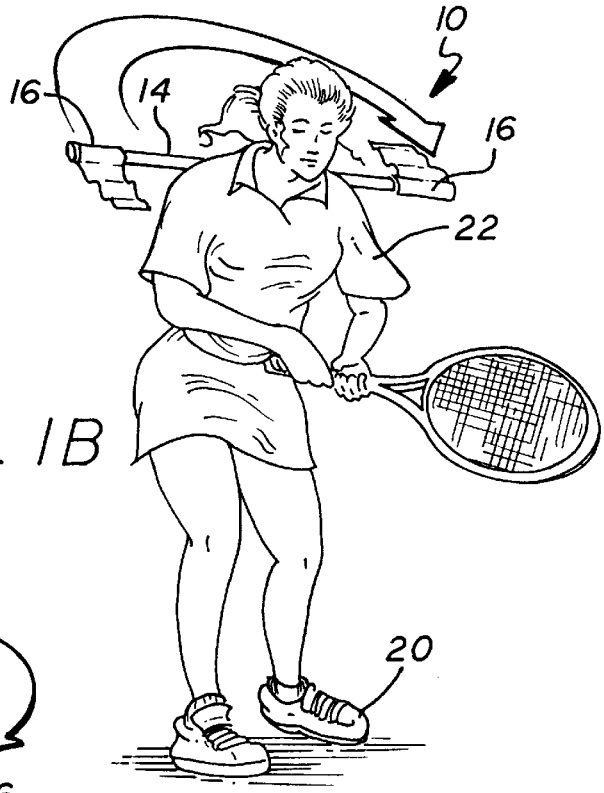
Figure 1C:
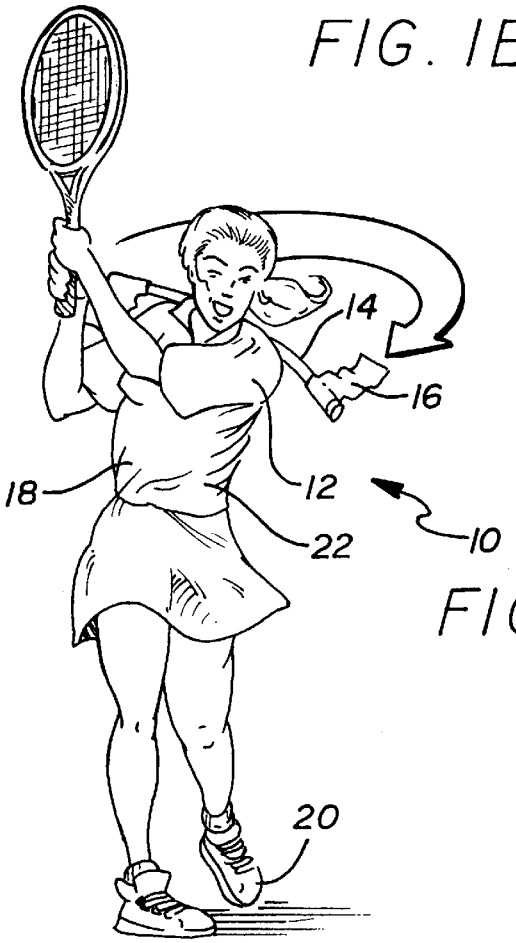

FIGS. 1A, 1B, 1C depict tennis player 10 executing a typical two-handed backhand ground stroke. FIG. 1A specifically shows player 10 preparing for the backhand stroke with proper rotation of her shoulders 12 prior to striking the oncoming tennis ball. FIG. 1B illustrates tennis player 10 immediately before hitting the tennis ball. FIG. 1C shows tennis player 10 undergoing her follow through after striking the tennis ball.

As seen in these drawings, tennis player 10 is using an exemplary embodiment of the present invention athletic stroke training device 14, which is attached to her shoulders 12. The athletic stroke training device 14 essentially includes a rod which has at opposite ends indicator 16 that functions as a visual stimulus. The rod preferably extends shoulder to shoulder so that indicator 16 appears in the player's peripheral vision. In the exemplary embodiment shown here, the visual stimulus is a flag. Although the drawings show the flags as fairly identical in shape, it is contemplated that the flags can be of different colors or shapes to help in training the player for a forehand versus a backhand stroke.

As seen in FIG. 1A, indictor 16 at one end of the rod is useful to player 10 to insure that she properly prepares for a stroke with sufficient shoulder rotation as well as alignment of hips 18 and feet 20. The appearance of indicator 16 is a visual cue to player 10 of proper preparation, and serves to align her body with the oncoming ball to execute the stroke.

As seen in FIG. 1C, the opposite end of the rod of athletic stroke training device 14 appears in the player's peripheral vision. This provides another visual cue for player 10 to help her achieve a full and complete follow through. Such a full follow through helps improve rhythm, consistency, and power.

Figure 2A:
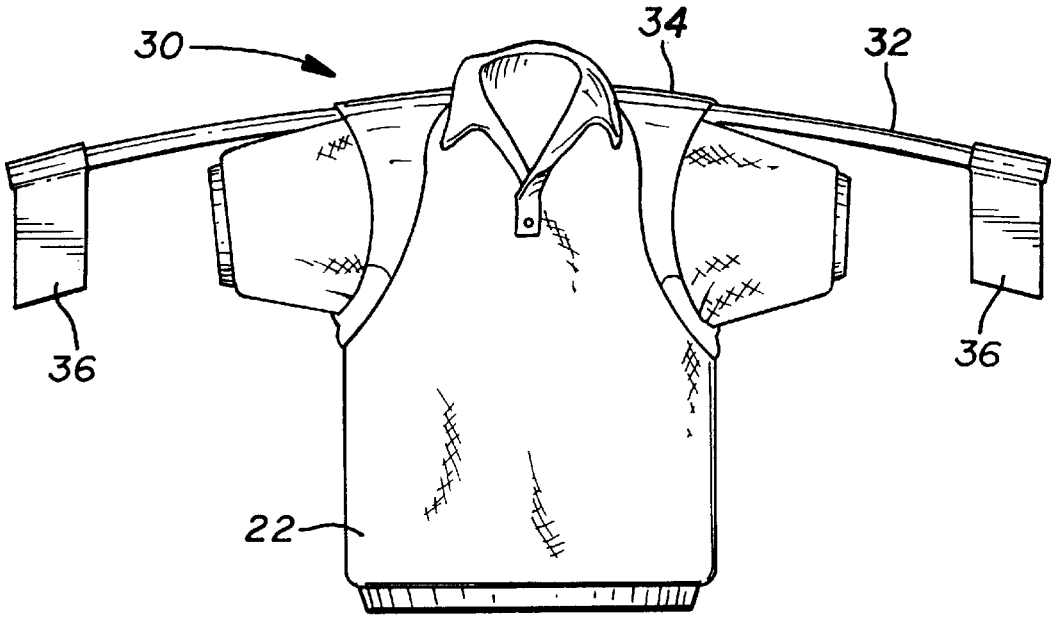
FIGS. 2A and 2B depict exemplary embodiments of the present invention stroke training device wherein the horizontal alignment member is attached to the garment by a harness as seen in FIG. 2A, or by use of complementary hook and loop fasteners incorporated into the garment as seen in the rear elevational view of the garment in FIG. 2B.
Figure 2B:
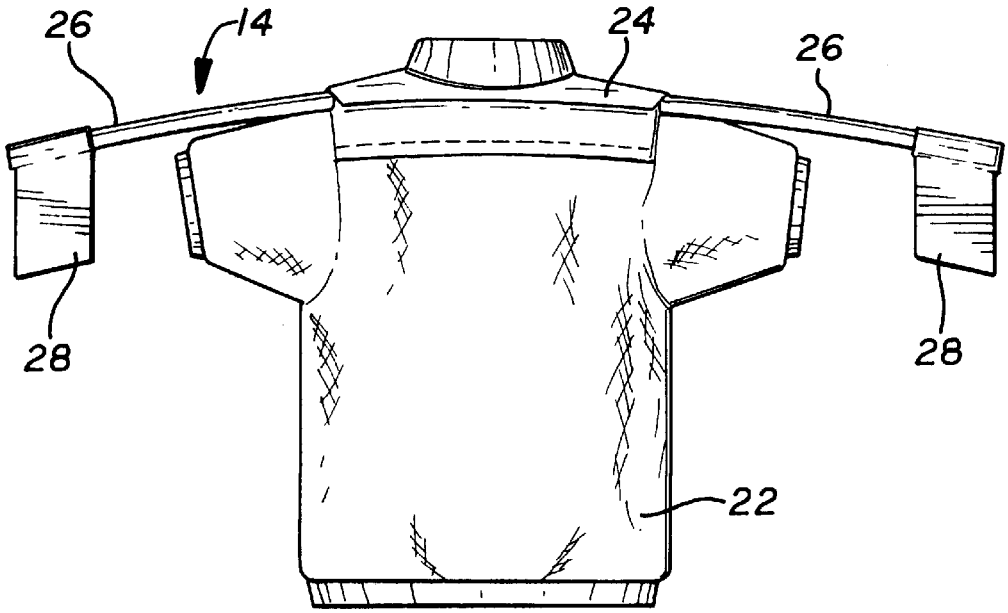

FIG. 2B is a rear elevation view of garment 22 worn by tennis player 10 in FIGS. 1A–1C. In this exemplary embodiment, garment 22 has flap 24 that is sewn or glued to the shoulder area. Flap 24 further includes complementary hook and loop fasteners, known in the art a VELCRO, in order to secure the athletic stroke training device 14 to the back of garment 22. In addition, the athletic stroke training device 14 has a semi-rigid shaft 26 terminated at opposite ends by flags 28. Hence, flap 24 wraps over shaft 26 and attaches to the back of garment 22 by use of VELCRO.

The outside surface of the middle part of shaft 26 can be textured or may include ribs to prevent shaft 26 from sliding laterally relative to garment 22. It is contemplated that shaft 26 be made from plastic, wood, aluminum, and that flags 28 be made from plastic, cotton fabric, or other like materials known in the art. As mentioned earlier, flags 28 can be made to different colors, patterns, or shapes to provide the necessary visual cues for the player.

Use of the aforementioned flap and VELCRO closure allows the athletic stroke training device 14 to be detached from garment 22 so that the latter can be washed. It further allows some degree of vertical adjustment in placement of shaft 26 relative to garment 22.

FIG. 2A provides a front elevation view of an alternative embodiment of the present invention. In this embodiment, the athletic stroke training device 30 is comprised of shaft 32 attached to shoulder harness 34. The opposite ends of the athletic stroke training device 30 include flags 36. Shoulder harness 34 is ideally worn over garment 22 as seen in FIG. 2A. As in the previous embodiment, shaft 32 can be attached to shoulder harness 34 through a variety of methods known in the art. For example, shaft 32 can be simply bonded to the shoulder harness, or strapped to the shoulder harness using VELCRO or elastic bands. Shoulder harness 34 is versatile because it can be easily transferred from one person to the next, thus permitting the athletic stroke training device 30 to be used among a large number of players.

Figure 3A:
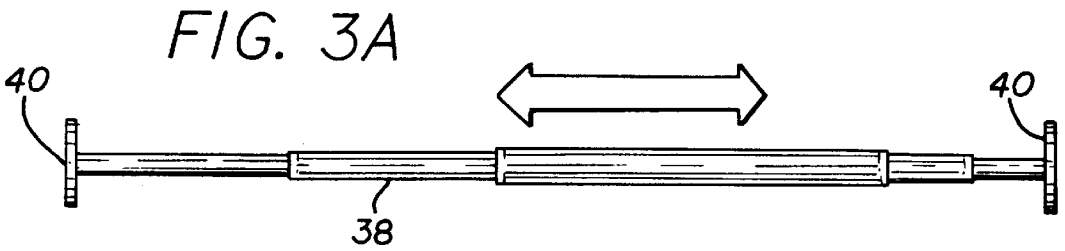
FIG. 3A is a side elevational view of an alternative embodiment horizontal alignment member constructed from a telescopic rod having flat disks at either end.
Figure 3B:
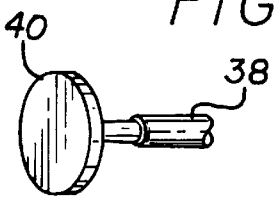
FIG. 3B is a perspective detail view of an alternative embodiment visual stimulus having a disk shape.
Figure 3C:
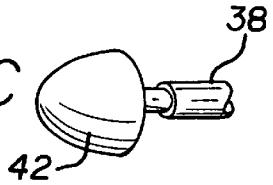
FIG. 3C is a perspective detail view of an alternative embodiment visual stimulus having a dome shape.

FIG. 3A is a side elevational view of an alternative embodiment horizontal alignment member for use with the present invention athletic stroke training device, such as that shown in FIGS. 1 and 2. In FIG. 3A, the horizontal alignment member is comprised of telescoping rod 38. Telescoping rod 38 can be assembled from a series of axially aligned hollow tube sections having slightly varying diameters. The sections can be fashioned from fiberglass, plastic, lightweight metals, or even rigid paper. Beneficially, this embodiment of the horizontal alignment member enables the length of rod 38 to be adjusted as indicated by the arrow. At each end of rod 38 is an indicator, which in this embodiment is a plastic disk 40. Disk 40 can be manufactured in various bright colors to catch the eye. A detail view of plastic disk 40 is shown in the perspective view of FIG. 3B. In another alternative embodiment of the horizontal alignment member, plastic disk 40 can be replaced by rubber bumper 42, as seen in FIG. 3C.

Telescoping rod 38 can be incorporated into the harness embodiment shown in FIG. 2A or the fold over VELCRO garment flap embodiment shown in FIG. 2B. Telescoping rod 38 permits the present invention to be adapted to players having a large variety of physiques and specifically to those with very broad or very narrow shoulders.

Figure 4A:
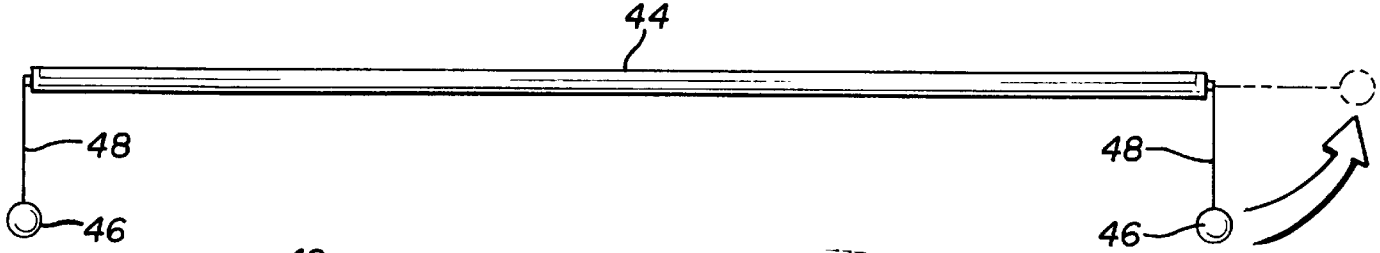
FIGS. 4A and 4B are side elevational view of an alternative embodiment horizontal alignment member having weighted balls at either end suspended by wires.

FIG. 4A provides a side elevational view of yet another alternative embodiment horizontal alignment member. In this embodiment, the horizontal alignment member is constructed from straight rod 44 wherein each end of rod 44 includes weighted ball 46, which is suspended from rod 44 by a string or wire 48. Again, straight rod 44 of this embodiment is easily adapted to fit in the shoulder harness shown in FIG. 2A or the garment flap shown in FIG. 2B.

Figure 4B:
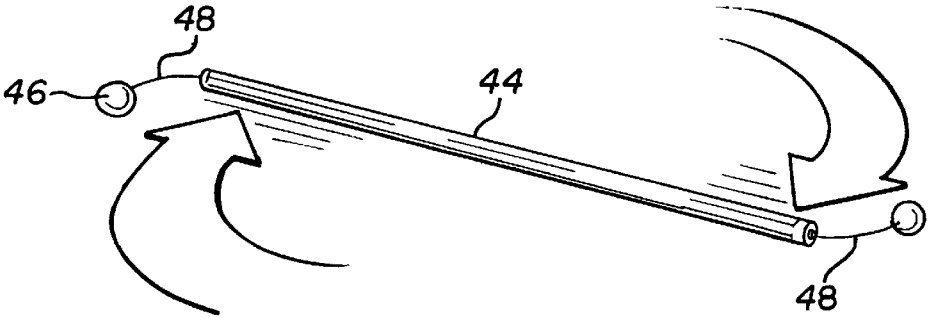
Figure 5:
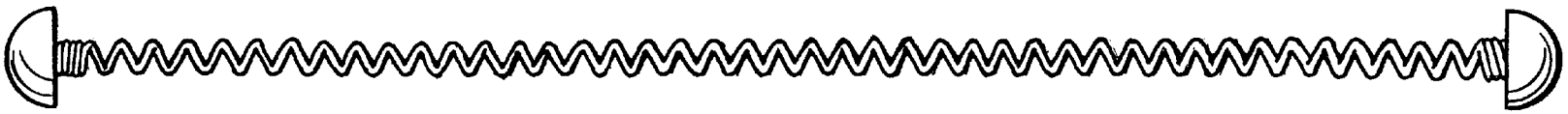
FIG. 5 is an alternative embodiment horizontal alignment member that is constructed from a coiled spring with dome shaped indicators at opposite ends.
Figure 6B:
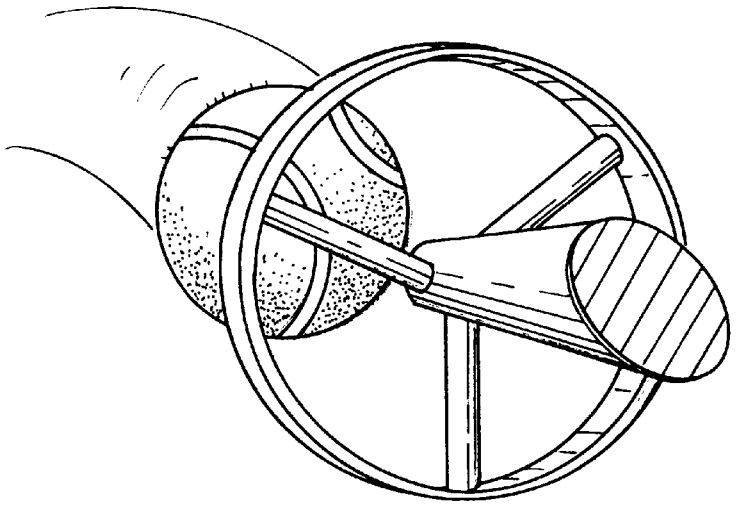
FIGS. 6A and 6B are perspective views of an alternative embodiment indicator used for sighting the target.
Figure 6A:
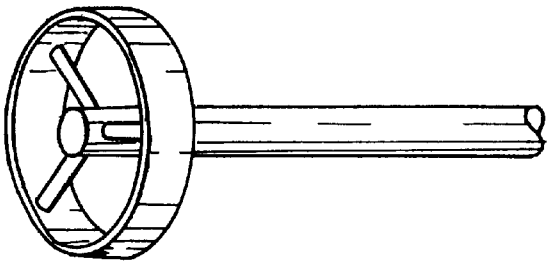

A benefit of the embodiment shown in FIG. 4A is that suspended balls 46 give the player an idea of the speed of his or her shoulder rotation. In particular, the centrifugal force created by rapid shoulder rotation causes weighted balls 46 to accelerate radially, and this is shown in the perspective view of FIG. 4B. With each shoulder or hip rotation during execution of the stroke, the amount of outward, radially movement of weighted balls 46 is proportional to the speed of that shoulder or hip rotation. Hence, the player can associate the rotational speed of his shoulders or hips with the depth or power behind the stroke.

In the exemplary embodiment shown here, weighted ball 46 can be formed from a dense plastic or metal while wire 48 can be made from plastic fishing line, rope, metal filament, or like material known in the art. Weighted ball 46 can be, of course, replaced by other objects that are eye-catching for easy sighting by the player. To be sure, weighted ball 46 can be replaced by objects having other shapes including a pyramid, a block, a cylinder, or the like.

Figure 7:
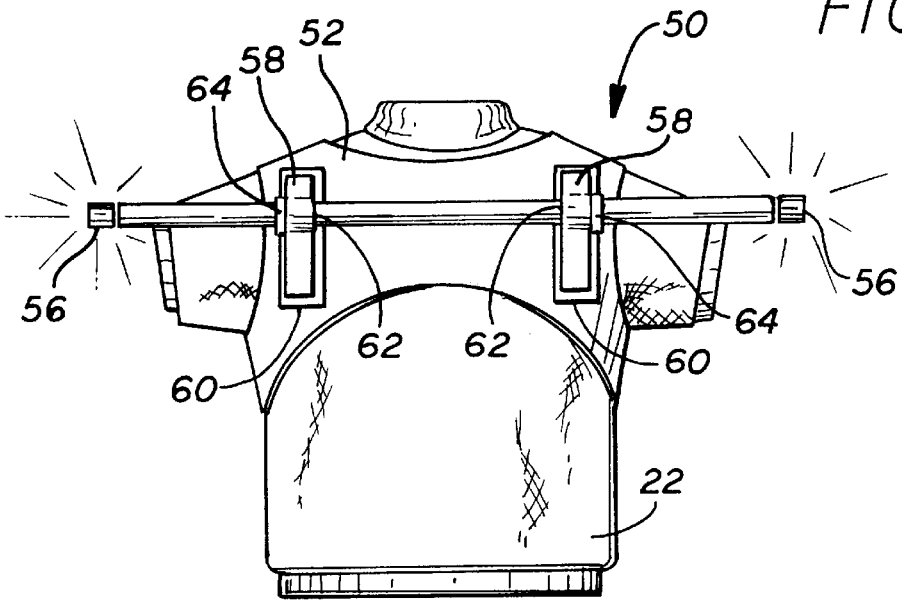
FIG. 7 is a rear elevational view of a harness attached to a garment and showing a vertically adjustable horizontal alignment member wherein the indicators at each end provide self-powered illuminating lamps.

FIG. 7 provides a rear elevational view of an alternative embodiment athletic stroke training device 50. In this exemplary embodiment, athletic stroke training device 50 is comprised of shoulder harness 52 that is worn over garment 22 akin to the embodiment shown in FIG. 2A. Training device 50 includes shaft 54 that preferably has a hollow interior or at least hollow portions. Within the hollow interior is a battery compartment used to power an illumination source 56 such as an incandescent lightbulb, a neon strobe, an LED, or the like. The necessary circuitry required to power the LED by battery is known in the art. Regardless of the choice of the light illumination source, it should preferably be powerful enough to be seen in daylight.

Illumination source 56 is preferably positioned at the ends of shaft 54. Shaft 54 is then attached to shoulder harness 52 by use of complementary hook and loop fasteners 58, 60. The hook and loop fasteners 58, 60 secure shaft 54 to shoulder harness 52 in the conventional manner, and also provides vertical adjustment of shaft 54 by simply relocating openings 62 in the hook and loop fasteners 58, 60 upward or downward. Moreover, shaft 54 includes optional ribs 64 to prevent unwanted lateral movement or sliding of shaft 54.

Figure 8:
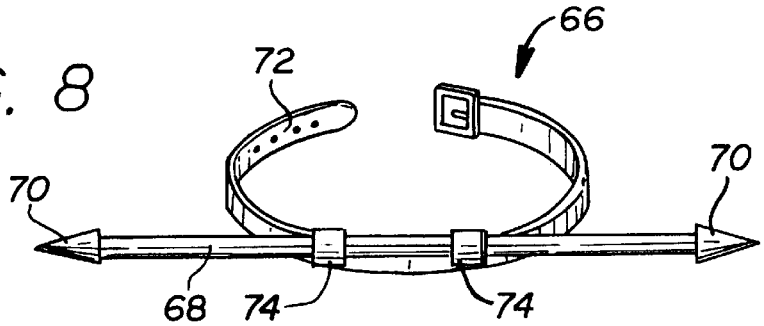
FIG. 8 is a rear elevational view of an alternative embodiment horizontal alignment member having cone shaped indicators and being attached to a belt to be worn around the players hips.

FIG. 8 is a perspective view of still another alternative embodiment of the present invention athletic stroke training device 66. In this embodiment, stroke training device 66 is comprised of straight shaft 68 having cone shaped indicators 70 at either end. Straight shaft 68 is attached to belt 72 so that stroke training device 66 can be worn around the waist of a player. Accordingly, stroke training device 66 is useful in practicing proper hip rotations, because cone-shaped indicators 70 provide visual cues to the player. Straight shaft 68 is attached to the belt 72 by stitched loops 74, but the same can be accomplished with tape, straps, or the like.

Figure 9:
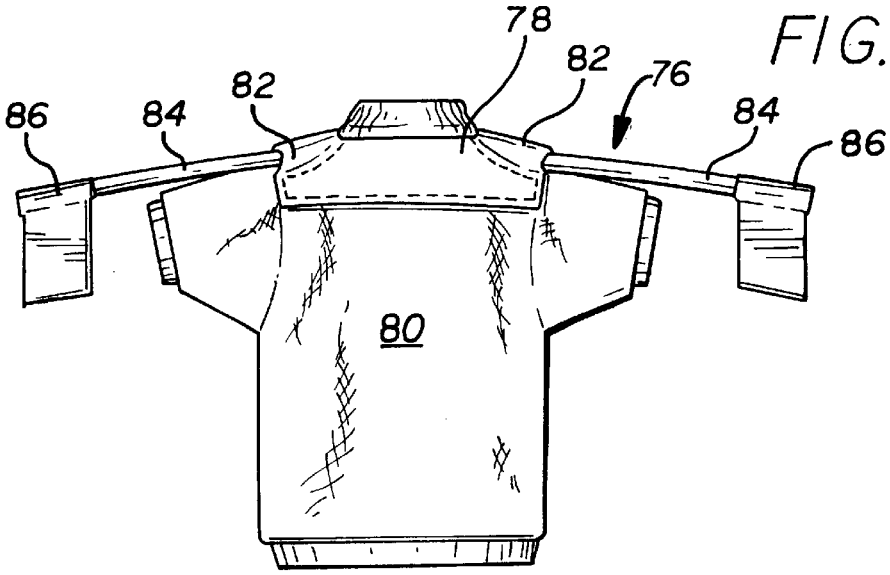
FIG. 9 is a rear elevational view of a garment incorporating a horizontal alignment member that is sewn into the garment and has outwardly extending arms with flags that serve as the visual stimulus.

FIG. 9 is a rear elevational view of an alternative embodiment of the present invention athletic stroke training device 76. Stroke training device 76 includes horizontal alignment member 78 constructed from a panel that is stitched or sewn into the shoulder area of garment 80. Horizontal alignment member 78 includes two pockets 82, each of which is used to receive one end of short shaft 84. At the opposite end of short shaft 84 is visual indicator 86, which in this case is a flag. As seen in FIG. 9, this embodiment omits the need of a continuous shaft that might be uncomfortable to the player if it abuts against the vertebrae. Moreover, in yet another alternative embodiment (not shown), short shafts 84 can be replaced with arm bands or the like that support indicators that extend off the shoulders again to provide a visual cue for proper shoulder rotation.

There are, of course, modifications that can be made to the present invention without departing from the scope thereof. In the foregoing description, the specific dimensions, procedural steps, and materials of construction are provided only as examples, and substitutes are readily contemplated which do not depart from the invention.

What is claimed is:

1. An athletic stroke training device for mounting to a player having shoulder blades comprising:

a horizontal alignment member having axially extendable opposed ends;

an indicator at each opposed end of the horizontal alignment member having a large, visual stimulus, and which provides the player performing the stroke training with a visual measurement of the extent of rotation of the shoulders;

wherein the stroke training device is attached to the player and overlying the shoulder blades.

2. The athletic stroke training device of claim 1, wherein the device includes a harness holding the horizontal alignment member and worn by the player so that the horizontal alignment member overextends both shoulder blades.

3. The athletic stroke training device of claim 1, wherein the harness includes a strap wrapping the horizontal alignment member therein, and the strap includes complementary hook and loop fasteners allowing the horizontal alignment member to be adjusted vertically.

* * * * *

UNITED STATES PATENT AND TRADEMARK OFFICE

CERTIFICATE OF CORRECTION

PATENT NO. : 6,102,809

DATED : Aug. 15, 2000

INVENTOR(S) : Steven B. Nichols

It is certified that error appears in the above-identified patent and that said Letters Patent is hereby corrected as shown below:

Title page, after "Assignee:", change "Kswiss", to read --K-SWISS--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*